US006311837B1

(12) United States Patent
Blaustein et al.

(10) Patent No.: US 6,311,837 B1
(45) Date of Patent: Nov. 6, 2001

(54) PACKAGING ARRANGEMENT HAVING RECESSES FOR PREVENTING A SWITCH FROM BEING PLACED IN A CONTINUOUSLY-ON POSITION

(75) Inventors: Lawrence A. Blaustein; John Osher, both of Moreland Hills; John R. Nottingham, Hunting Valley; John W. Spirk, Gates Mills, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/536,731

(22) Filed: Mar. 28, 2000

(51) Int. Cl.[7] ..... B65D 83/00

(52) U.S. Cl. ..... 206/362.2; 206/471; 206/459.5; 206/806; 15/28

(58) Field of Search ..... 206/361, 461, 206/471, 467, 351, 459.5, 459.1, 775, 776, 806, 362.2, 362.3, 15.2–15.3; 15/167.1, 22.1, 28

(56) References Cited

U.S. PATENT DOCUMENTS

| | | | | |
|---|---|---|---|---|
| 3,533,503 | * | 10/1970 | Wood et al. | 206/776 |
| 4,702,374 | | 10/1987 | Kelner . | |
| 4,925,025 | | 5/1990 | Anten et al. . | |
| 5,129,516 | | 7/1992 | Theros . | |
| 5,188,222 | | 2/1993 | Pierce . | |
| 5,289,916 | | 3/1994 | Mickelberg . | |
| 5,411,138 | | 5/1995 | Klawiter . | |
| 5,613,609 | | 3/1997 | Hamilton et al. . | |
| 5,718,335 | | 2/1998 | Boudreaux . | |
| 5,890,593 | * | 4/1999 | Humphrey | 206/471 |
| 5,896,991 | * | 4/1999 | Hippely et al. | 206/461 |
| 5,919,074 | | 7/1999 | Honda . | |
| 5,954,204 | | 9/1999 | Grabowski . | |
| 6,189,693 | * | 2/2001 | Blaustein et al. | 206/362.2 |

* cited by examiner

*Primary Examiner*—Luan K. Bui
(74) *Attorney, Agent, or Firm*—Fay, Sharpe, Fagan, Minnich & McKee, LLP

(57) ABSTRACT

A package for an article incorporating an on/off switch having a momentary-on position and a continuously-on position is disclosed. The package includes a cover such as a blister-type cover at least partially enclosing the article, and a recess arrangement formed in the cover proximate the switch. The recess arrangement prevents the switch from being slid into the continuously-on position while permitting the switch to be depressed into a momentary-on position. The recess arrangement includes a first recess positioned directly over the switch, and a second recess positioned directly adjacent the switch.

9 Claims, 2 Drawing Sheets

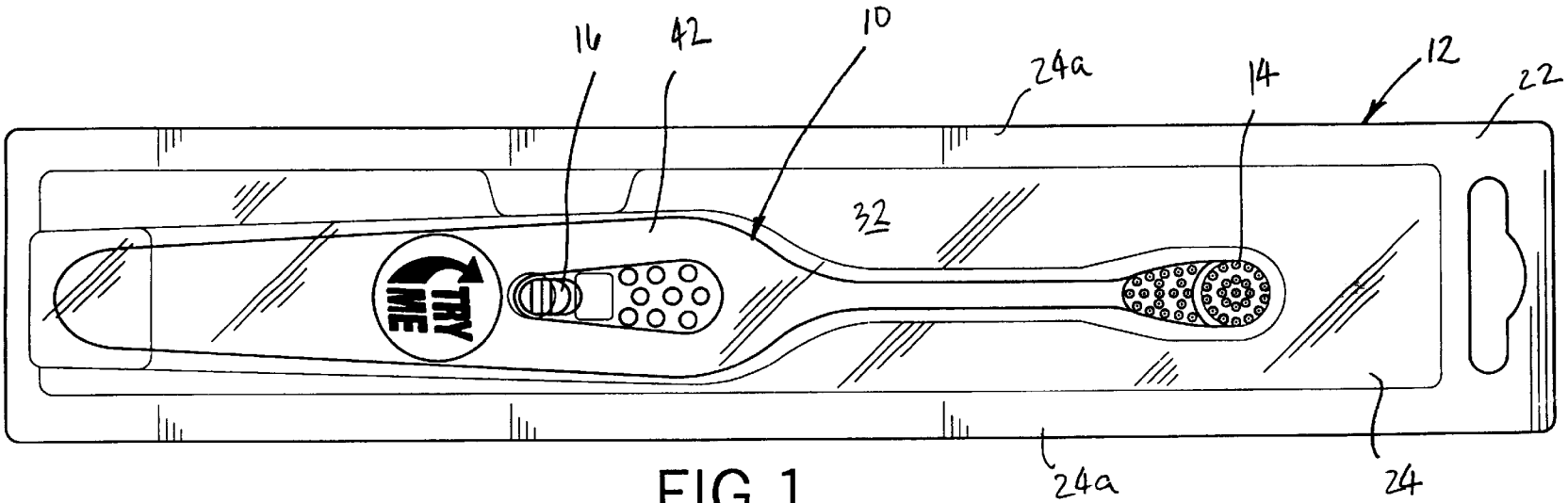
FIG.1
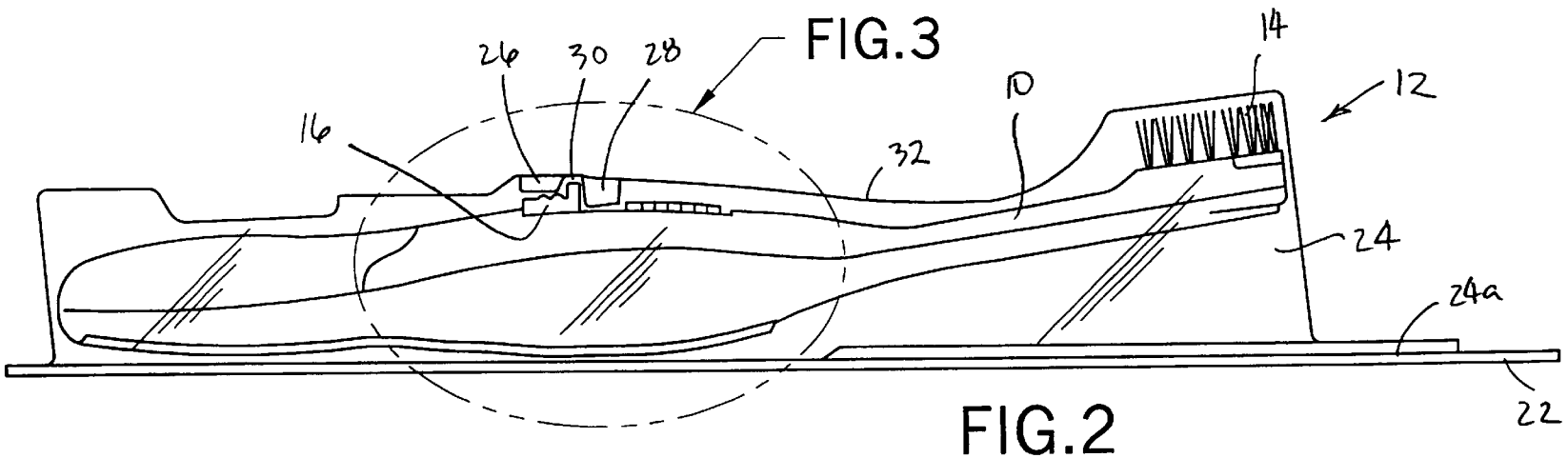
FIG.2
FIG.3

PACKAGING ARRANGEMENT HAVING RECESSES FOR PREVENTING A SWITCH FROM BEING PLACED IN A CONTINUOUSLY-ON POSITION

FIELD OF THE INVENTION

The present invention relates generally to the product packaging art, and more particularly, to a recess arrangement for a blister pack that allows a switch or button to be placed into a first position, and prevents the switch or button from being placed into a second position.

BACKGROUND OF THE INVENTION

Blister packs or cards, and variants thereof such as skin packs or packages, contour packs or packages, and bubble packs or packages, are ubiquitous in the retail merchandising industry. Blister packaging generally refers to a method of packaging articles in transparent, thermoformed "blisters" or pouches that range from precisely matching to generally matching or otherwise corresponding to the contours of the article to be packaged. The preformed (e.g. vacuum formed) blisters are made of thermoplastics such as vinyls (e.g. polyvinyl chloride (PVC)), polystyrene, or cellulosic plastics. They are typically placed inverted in fixtures, loaded with the articles, then cards coated with an adhesive are applied and sealed to the flanges of the blisters by means of heat and pressure.

The retail merchandising industry has recently embraced the so-called "try me" marketing strategy whereby potential purchasers are invited to try out or otherwise test a product prior to making a purchase. In the case of electronically operated products, manufacturers must install batteries into the product if potential purchasers are to activate or energize the product.

For instance, U.S. Pat. No. 4,925,025, issued to Anten, discloses a point-of-purchase display that permits a potential purchaser to temporarily energize a toy packaged within a blister-type packaging arrangement. The toy includes activation buttons which are accessible through an opening in the bottom of the package. The opening may be covered by a reinforced plastic membrane. Likewise, U.S. Pat. No. 5,188,222, issued to Pierce discloses a blister-type display package arrangement with recesses that permit a potential purchaser to squeeze an animated timepiece and thereby actuate a switch that causes the animated timepiece to actuate.

Further, U.S. Pat. Nos. 5,129,516; 4,702,374; and 5,718,335; issued to Theros, Kelner, and Boudreaux, respectively, generally disclose blister-type packaging arrangements that have apertures to permit access to a product so that a potential purchaser can directly manipulate the product in some manner. For instance, the Theros patent discloses a blister package for a tape measure including an opening for accessing and withdrawing the measuring tape from the tape measure housing. Lastly, U.S. Pat. Nos. 5,919,074; 5,289,916; and 5,411,138, issued to Honda, Mickelberg, and Klawiter, respectively, generally disclose packaging arrangements that permit access to a switch for activating battery-operated products such as toys, dolls, etc.

Some articles or products incorporate a two-feature activation or on/off switch or button. A "press and hold" feature of the switch permits the product to be energized and de-energized by simply depressing and releasing the on/off switch (e.g. a temporarily-on feature). A "press and slide" feature of the switch permits the product to remain energized when the on/off switch is slid in a first direction and then released (e.g. a continuously-on feature). The product is deactivated by sliding the on/off switch in an opposing direction.

In the case of try-me packaging for an article having a two-feature on/off switch, it is contemplated that a potential purchaser could inadvertently or maliciously slide the on/off switch into the continuously on position, thereby continuously energizing the article and expending or otherwise draining the batteries. Further, it is possible that the switch could slide into the continuously on position during shipment of the product from the manufacturer, thus draining the batteries prior to arriving at the retailer. Clearly, it is less desirable to purchase a product with spent or discharged batteries, than a product with substantially fully charged batteries.

Further, known "try me" blister pack-type packaging arrangements are not suitable for use with articles or products that should remain in a sanitary state. That is, providing a hole or aperture through a blister in order to directly access a button or switch of the article, also serves to permit contaminates (pathological, biological, or otherwise) to reach the article.

Accordingly, it is considered desirable to provide a new and improved blister pack that is enclosed to maintain the sanitary condition of article while at the same time permitting a two-feature switch/button to be placed in a first position while preventing the switch/button from being placed in a second position.

SUMMARY OF THE INVENTION

The principal object of the present invention is to provide a blister-type packaging arrangement that is sealed to maintain the sanitary condition of article while at the same time permitting a switch/button to be placed in a first position while preventing the switch/button from being placed in a second position.

In accordance with one aspect of the present invention, a package for an article incorporating a switch having a momentary-on position and a continuously-on position is disclosed. The package includes a cover at least partially enclosing the article, and a recess arrangement formed in the cover proximate the switch. The recess arrangement prevents the switch from being urged into the continuously-on position.

In accordance with a second aspect of the present invention, a packaging arrangement for an article incorporating a two-position switch is disclosed. The packaging arrangement includes a cover at least partially enclosing the article, and a recess arrangement associated with the cover, the recess arrangement permitting the switch to be placed into a first position and preventing the switch from being placed into a second position.

One advantage of the present invention is the provision of a new and improved packaging arrangement that prevents an on/off switch associated with a packaged article from being slid into a continuously-on position while permitting the switch to be depressed into a momentary-on position.

Another advantage of the present invention is the provision of a try-me packaging arrangement that maintains a sanitary state of the packaged article.

Still another advantage of the present invention is the provision of a packaging arrangement that incorporates a rib for preventing a recess from collapsing from repeated use.

Yet another advantage of the present invention is the provision of a packaging arrangement that provides a recess for preventing a switch from being slid into a continuously-on position.

A further advantage of the present invention is the provision of a packaging arrangement that permits a potential purchaser to test or otherwise try-out a product at the point-of-purchase.

Yet a further advantage of the present invention is the provision of a try-me packaging arrangement that prevents batteries associated with the packaged product from being drained or discharged.

A still further advantage of the present invention is the provision of a packaging arrangement that prevents an on/off switch associated with a product from being moved into a continuously-on position during transit or shipment to a retailer.

Still further advantages of the present invention will become apparent to those of ordinary skill in the art upon reading and understanding the following detailed description of the preferred embodiment.

BRIEF DESCRIPTION OF THE DRAWINGS

The invention may take form in various components and arrangements of components, and in various steps and arrangements of steps. The drawings are only for purposes of illustrating a preferred embodiment, and are not to be construed as limiting the invention.

FIG. 1 is a top plan view of an exemplary article that is sealed within a blister-type packaging arrangement that incorporates the features of the present invention therein;

FIG. 2 is side elevation view of the exemplary article and blister pack of FIG. 1.

DETAILED DESCRIPTION OF THE PREFERRED EMBODIMENT

Figure 3:
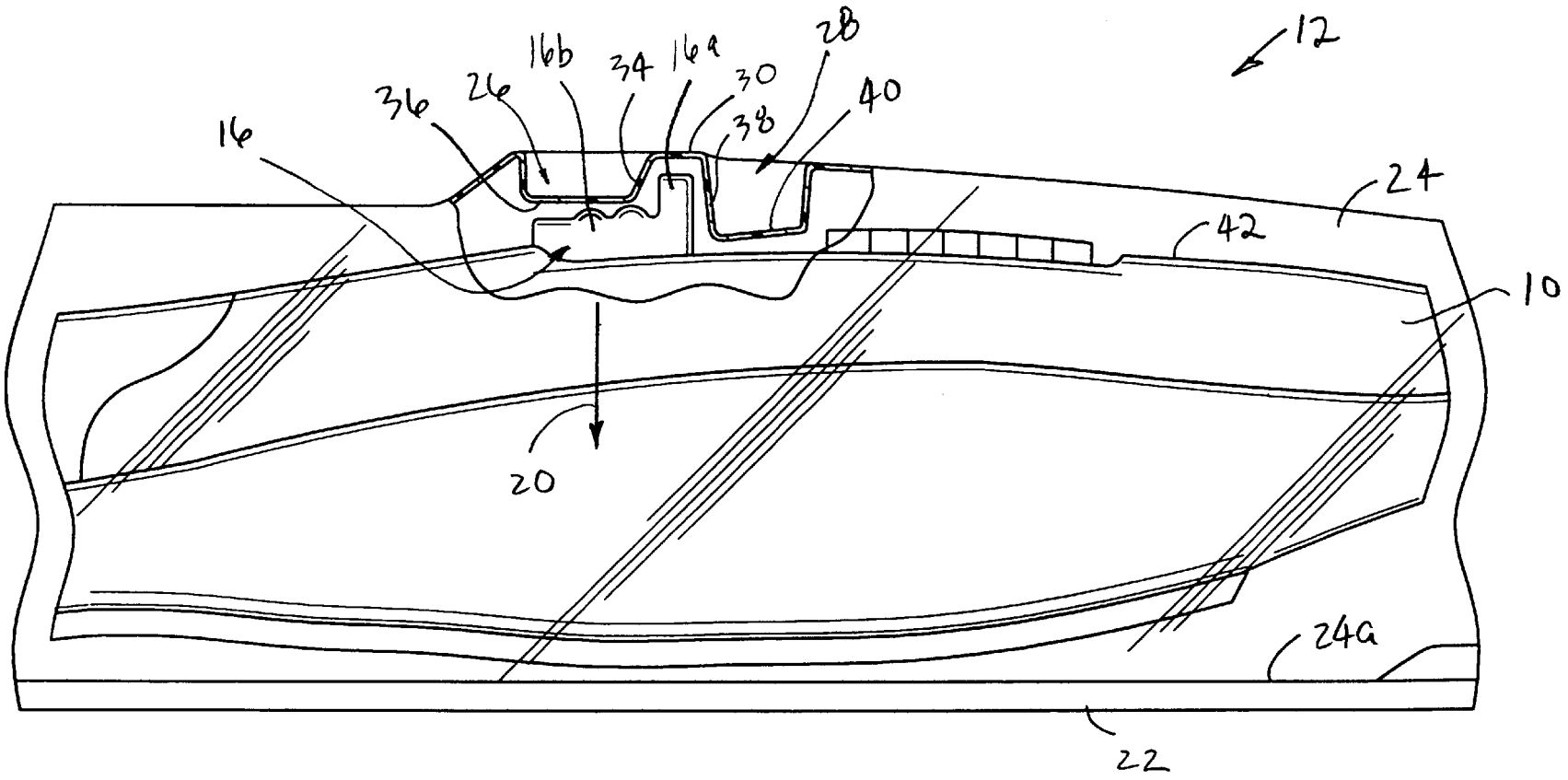
FIG. 3 is an enlarged view of a switch portion of the exemplary article and associated recess arrangement of the blister pack of FIG. 1.

Referring now to FIGS. 1–3, there is shown an exemplary article 10 that is enclosed within a blister-type packaging arrangement 12. In the embodiment being described, the article 10 is a battery-operated toothbrush product that includes oscillating bristles 14 that can be activated and deactivated by a conventional two-feature or two-position on/off switch 16.

Certain terminology is used herein to describe the article 10 and blister-type packaging arrangement 12 for convenience in reference only, and is not to be construed as limiting. For example, as best shown in FIG. 3, the on/off switch 16 is contoured with a raised "forward" portion 16*a* that facilitates urging the switch into a "forward" continuously-on position, and a "lower" or rear portion 16*b* with slight projections that provide a user with a gripping surface.

A "press and hold" feature of the switch 16 permits the toothbrush 10 to be energized by depressing and holding the switch 16 in a momentary-on position (i.e. in the direction of arrow 20). The toothbrush 10 is de-energized by simply releasing the switch 16. A "press and slide" feature of the switch 16 permits the toothbrush 10 to remain energized when the on/off switch 16 is slid forward (i.e. in a direction toward the bristles 14) into the continuously-on position and then released. The toothbrush is de-activated from the continuously-on position by simply sliding the switch 16 backward in a direction away from the bristles 14.

The toothbrush 10 is packaged for sale with a backing card 22, such as a conventional paperboard backing card, that is covered by a transparent blister 24. In the embodiment being described, flanges 24*a* of the blister 24 can be adhesively bonded to the backing card 22 in a conventional manner. The blister 24 can be molded into the shape of the toothbrush 10 with conventional techniques such as vacuum molding. In addition, the blister 24 can be formed from conventional thermoplastic materials such as vinyls (e.g. polyvinyl chloride (PVC)), polystyrene, or cellulosic plastics. As is known in the art, the blister 24 is some-what flexible and resilient. That is, the blister 24 will resiliently return to its original shape if slightly deformed.

A "try-me" feature of the blister pack permits a potential purchaser to demonstrate the oscillation of the bristles 14 by activating the toothbrush 10 at the point-of-purchase. The "try-me" feature includes a first recess 26, second recess 28, and rib 30 positioned between the first recess 26 and second recess 30. The recesses 26, 28 and rib 30 are formed in an upper surface 32 of the blister 24.

The first recess 26 is substantially aligned with the lower portion 16*b* of the on/off switch 16. In the embodiment being described, the recess 26 includes a generally upright, substantially cylindrical side wall 34 and a substantially circular bottom wall 36. The bottom wall 36 is adapted to contact the lower portion 16*b* of the switch 16. The second recess 28 is positioned immediately adjacent (i.e. in front of) the switch forward portion 16*a*. In the embodiment being described, the recess 28 includes a generally upright, substantially rectangular side wall 38 and a bottom wall 40. The bottom wall 40 of the second recess 28 extends below an upper extent of the switch forward portion 16a. The rib 30, formed from adjacent portions of the sidewalls 34, 38, generally conforms to the shape of, and substantially covers, the forward portion 16*a* of the switch 16.

In operation, the toothbrush 10 can be temporarily energized at the point-of-sale by simply pressing the recess 26 down into contact with the switch 16. Continued pressure on the recess 26 depresses the switch 16 against a spring force into the momentary-on position thereby actuating the bristles 14. When the pressure on the recess 26 is released, the recess 26 and switch 16 return to their original position and the toothbrush 10 is deactivated.

When the recess 26 is urged into contact with the switch lower portion 16*b*, the bottom wall 40 of the second recess 28 contacts an upper surface 42 of the toothbrush 10 to effectively block or otherwise prevent the switch 16 from being inadvertently or maliciously slid forward into the continuously-on position. It should be appreciated that the rib 30 is substantially rigid and unyielding. Thus, the rib 30 assists in preventing the switch 16 from being placed in the forward momentary-on position by capturing and retaining the switch forward portion 16*a*.

Further, under a slight downward pressure, the bottom wall 40 of the recess 28 contacts the upper surface 42 of the toothbrush 10 at approximately the same point that the bottom wall 36 of the recess 26 contacts the switch lower portion 16*b*. A relatively large amount of additional downward force is then necessary in order to slightly deform the blister 24 and urge the switch 16 downward into the momentary-on position. Thus, the slight amount of downward forces that may be generated during the vagrancies of shipping products from the manufacturer to the retailer will only result in urging the bottom wall 40 of recess 28 against the toothbrush, and not result in urging the switch 16 downward into the momentary-on position.

With regard to the recess 26 alone, it is contemplated that the recess 26 could inevitably be compressed, flattened, or otherwise crushed by being repeatedly depressed. In such a state, it is possible that such a crushed recess 26 would apply a continuous downward pressure to the switch 16 to continuously energize the toothbrush 10 in the momentary-on position and thereby drain the batteries. However, because the adjacent rib 30 is substantially rigid and unyielding, it serves to prevent the recess 26 from being deformed after repeated usage, or from being crushed during shipment to the retailer.

Lastly, in view of the fact that the toothbrush 10 is activated and deactivated by indirect contact with the switch 16 vis-a-vis the recess 26, the toothbrush 10 is maintained in a sanitary state within the fully enclosed blister 24.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof. For instance, while the article 10 has been described and illustrated as a toothbrush, it is contemplated that the blister pack recess arrangement of the present invention can be used with other types of packaged articles. Further, the packaging arrangement has been described and illustrated with a blister-type cover. However, it is contemplated that the recess arrangement of the present invention is equally suitable for use with packaging materials other that thermoplastic blister covers.

Having thus described the preferred embodiment, the invention is now claimed to be:

1. In combination, a package and an article incorporating a switch having a momentary-on position and a continuously-on position, the package comprising a cover at least partially enclosing the article, and a recess arrangement formed in the cover proximate the switch, the recess arrangement preventing the switch from being urged into the continuously-on position, wherein the recess arrangement includes a first recess positioned over the switch and a second recess positioned adjacent the switch.

2. The combination of claim 1, wherein the second recess is spaced from the first recess by a rib.

3. The combination of claim 2, wherein the switch includes a raised portion and a lower portion, and wherein the rib generally conforms to and covers the switch raised portion.

4. The combination of claim 1, wherein the second recess extends below an upper extent of the switch to prevent the switch from being urged into the continuously-on position.

5. In combination, a package for an article incorporating a switch having a momentary-on position and a continuously-on position, the package comprising a cover at least partially enclosing the article, and a recess arrangement formed in the cover proximate the switch, the recess arrangement preventing the switch from being urged into the continuously-on position, wherein the switch is depressed to momentarily energize the article and the switch is slid to continuously energize the article, and wherein the recess arrangement includes a first recess to facilitate depressing the switch, and a second recess that prevents the switch from being slid into the continuously-on position.

6. In combination, a package for an article incorporating a switch having a momentary-on position and a continuously-on position, the package comprising a cover at least partially enclosing the article, and a recess arrangement formed in the cover proximate the switch, the recess arrangement preventing the switch from being urged into the continuously-on position, wherein the recess arrangement facilitates depressing the switch into the momentary-on position.

7. The combination of claim 6, wherein the cover is formed from a thermoplastic material and the recess arrangement is formed on an upper surface of the cover.

8. The combination of claim 6, further including a backing card adhesively bonded to the cover.

9. The combination of claim 6, wherein the article is a battery-operated toothbrush.

* * * * *